United States Patent [19]

Copeland

[11] Patent Number: 5,008,793

[45] Date of Patent: Apr. 16, 1991

[54] GUIDABLE ARM, PARTICULARLY FOR FREE-POSITIONING LAMPS

[75] Inventor: Stephan Copeland, New York, N.Y.

[73] Assignee: FLOS S.p.A., Bovezzo, Italy

[21] Appl. No.: 524,220

[22] Filed: May 7, 1990

[51] Int. Cl.[5] ..... F21S 3/12; F21V 21/32

[52] U.S. Cl. ..... 362/413; 362/419; 248/160

[58] Field of Search ..... 362/418, 419, 205, 413; 248/160, 279, 27 C

[56] References Cited

U.S. PATENT DOCUMENTS

| | | | |
|---|---|---|---|
| 2,558,259 | 6/1951 | Krug | 248/160 |
| 4,238,816 | 12/1980 | Merio | 362/419 |
| 4,630,185 | 12/1986 | Copeland | 362/419 |
| 4,912,612 | 3/1990 | Giorgio | 362/418 |

*Primary Examiner*—Ira S. Lazarus

*Assistant Examiner*—Richard R. Cole

*Attorney, Agent, or Firm*—McGlew & Tuttle

[57] ABSTRACT

A guidable arm for free-positioning lamps of the type with a stand anchored to a base and having a free end holding a lamp head. The guidable arm being made up of two stems which are separated in a parallel manner and which rotate about their own axis with respect to the fixed base. The stems are interconnected by a flexible intermediate spacer and are equipped at their free ends with joints for holding the lamp head. Each of the stems has two goose-neck portions separated from one another and made up of a flexible tube and a sheath having crosswise slits on two diametrically opposed areas and two uninterrupted lateral strips parallel to the axis of the stem. The goose-neck is thus able to bend in a direction orthogonal to the slits and not laterally toward the uninterrupted strips.

6 Claims, 2 Drawing Sheets

10
11
12
13
14
15
15'
15''
16
17
18
19
20
20'
20''
21
22
23

GUIDABLE ARM, PARTICULARLY FOR FREE-POSITIONING LAMPS

FIELD AND BACKGROUND OF THE INVENTION

The present invention refers in general to a guidable arm, and particularly, to a guidable arm for free-positioning lamps.

Guidable arms are known in the area of lamps, dentists' tools, etc., that are bendable, jointed or guidable, free-positioning arms, i.e., arms which have a stand anchored to a base and a free end holding a lamp head, tool, or other item to be positioned.

In the more common embodiments the position, which may be changed from time to time, of the arm is maintained and assured by reaction and balancing mechanisms including yielding elements, counterbalances and the like, which complicate the structure which depends on the size and shape of the apparatus.

SUMMARY AND OBJECT OF THE INVENTION

It is an object of the invention to propose a guidable arm of the above-mentioned type, made up of two parallel and freely positioning stems, without having to resort to supplementary reaction and/or balancing mechanisms.

Another purpose of the invention is to propose a guidable arm particularly for free-positioning lamps which can be bent and directed so as to correspond to two or more goose-neck arrangements in order to permit the lamps a multiple variety of positions on or with respect to one end attached or anchored to a base.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

DETAILED DESCRIPTION OF THE PREFERRED EMBODIMENT

Figure 1:
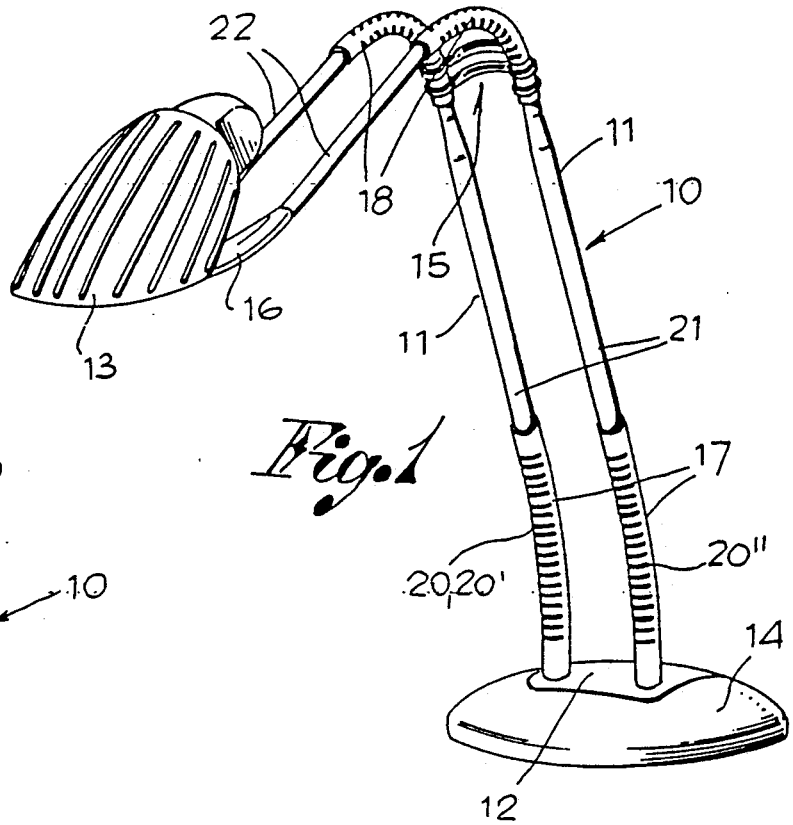
FIG. 1 is a prospective schematic view of a lamp incorporating the arm according to the invention.

The arm of the invention is generally designated 10 and is made up of two stems 11 each having one end which is anchored in a rotatable manner to a base 12. A free end of each stem 11 holds a lamp head 13 in the illustrated example.

The base may be attached to the top of a table by means of a bracket—not represented—or, as represented in the drawing, it may be integrated into a tip-proof base or stand 14. The two stems 11 constituting the arm 10 are equal to one another in length and separated from one another in an almost parallel manner, from the end anchored to the base to the free end. In the middle part, the two stems 11 are interconnected by at least one spacer 15, which will be described in the following, while at their free end the two stems are equipped with a double-shell joint designed to hold the lamp head 13.

According to the invention each stem 11 has a goose-neck portion 17 which is adjacent to the base 12 and a second goose-neck position 18 is provided in the arm middle part. The goose-necks 17, 18 of one stem are at the same level as those of the other stem and are constructed such as to permit a double bending of the stem in at least one direction, normally in a plane perpendicular to base 12 and containing the axis of the stem, with the stems bending simultaneously and in harmony with one another due to their interconnection in the middle via spacer 15 and to their connection at the free end to the lamp head 13.

Each goose-neck 17, 18 is made up of a flexible tube 19 and of a sheath 20 which contains it, and a rigid tubular element 21 is placed between the first and the second goose-neck, while another rigid tubular element 22 extends out from the second goose-neck, to the free end of which the joint 16 holding the lamp head 13 is attached.

According to a preferred arrangement of the invention the first goose-neck 17 of each stem 11 has its lower end connected to a base pivot 23, which permits the rotation of the stem around its own axis with respect to the base. The rigid tubular elements 21 are coupled and held axially by ends of the flexible tubes 19 and the sheath 20 of the goose-necks 17, 18. Each sheath 20 has crosswise slits 20' on two diametrically opposed areas contained between two uninterrupted lateral strips 20'' parallel to the axis of the same sheath. This makes it possible for the goose-necks to bend in a single direction contained in a plane orthogonal to the spaces and not laterally due to the continuous strips.

The intermediate spacer 15 mentioned above connects the rigid tubular elements 21 contained between the goose-necks 17, 18 and has two couplings 15' containing these elements and a pair of flexible bars 15'' connecting the two couplings. Therefore, the spacer 15 permits reciprocal movements between the two stems in both a longitudinal and lateral direction when these stems are rotated on the base pivots 23.

Figure 7:
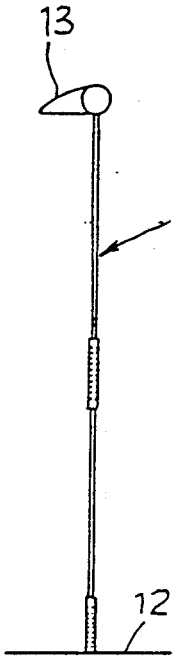
FIGS. 5, 6, and 7 are schematic views showing some of the possible positions that the arm may assume.
Figure 2:
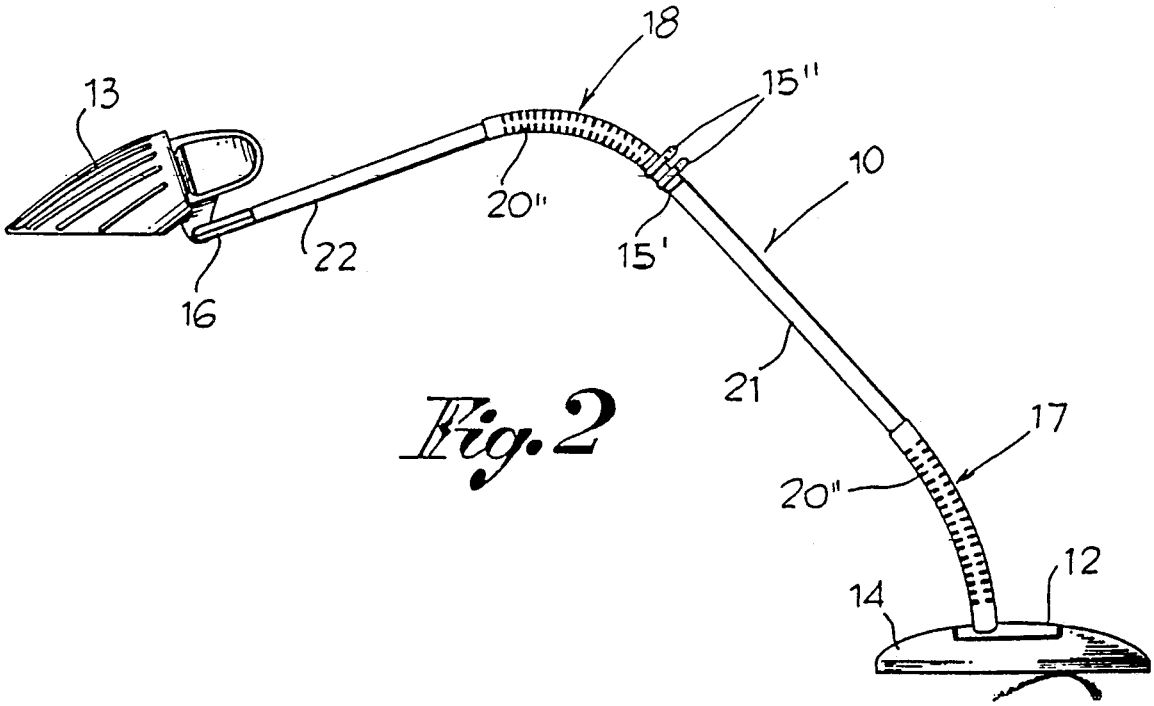
FIG. 2 is a perspective schematic view of a lamp incorporating the arm according the invention.
Figures 3, 4, 5, 6:
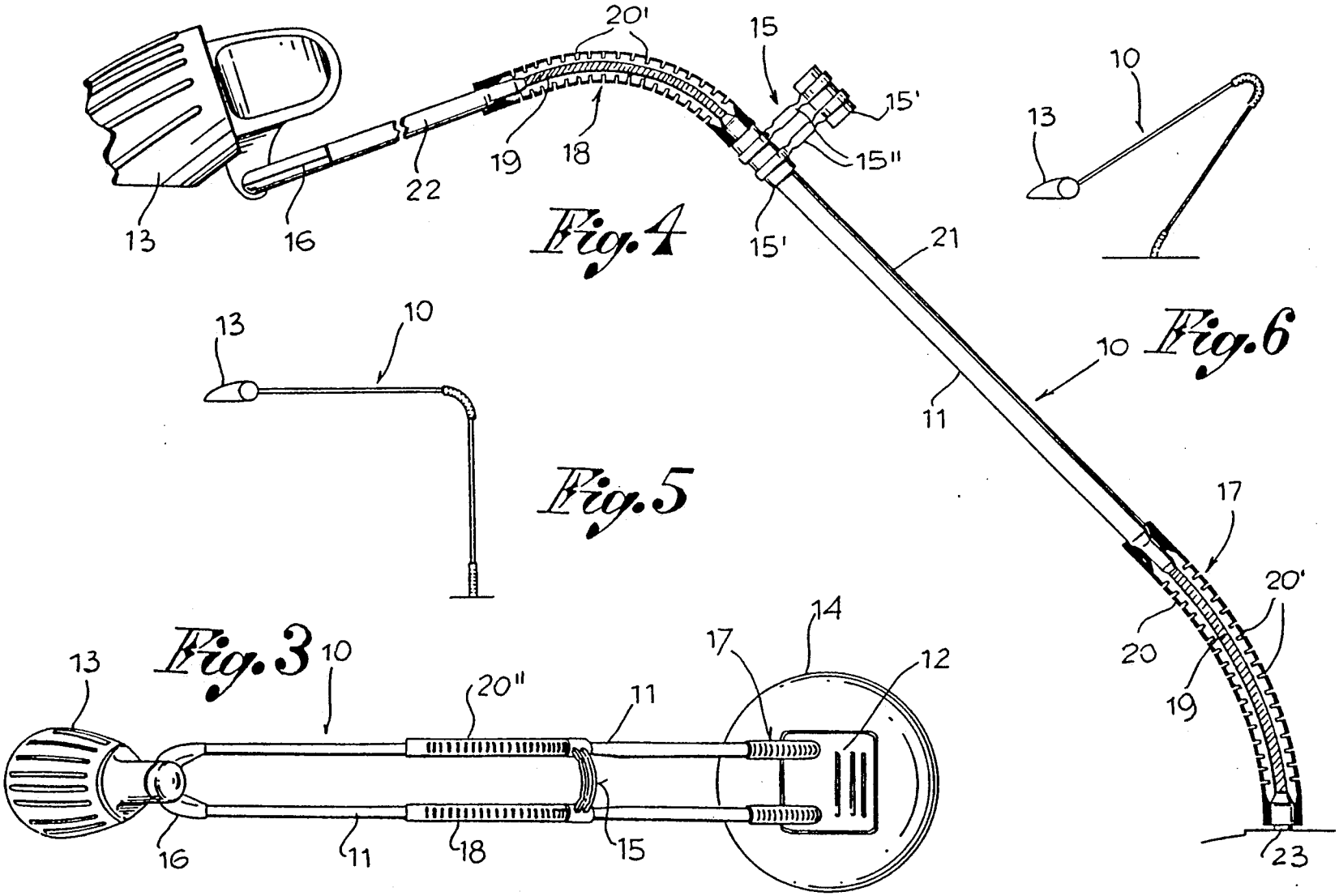
FIG. 3 is a top view of the lamp according to the invention.
FIG. 4 is a longitudinal sectional of one of the stems of the arm.

Finally, it should be noted that the lamp head 13 which may have any configuration is applied to the joint 16 at the free end of the stems 11 in such a way as to rotate and to be able to be guided at least around a horizontal axis. The structure is positionable as shown in FIGS. 5, 6, and 7 so as to arrange it to direct the light in the direction most suitable to any requirement, a condition which automatically continues to hold until it is intentionally altered anew.

While a specific embodiment of the invention has been shown and described in detail to illustrate the application of the principles of the invention, it will be understood that the invention may be embodied otherwise without departing from such principles.

What is claimed is:

1. Guidable arm particularly for free-positioning lamps of the type with a stand anchored to a base attached to a free end holding a lamp head, characterized by the fact that it is made up of two stems (11) equal to one another, separated in a parallel manner, rotating around their own axis, on and with respect to the fixed base, with these stems being interconnected by at least one flexible intermediate spacer (15) and being equipped at their free end with joints (16) holding the lamp head, by the fact that each of the said stems (11) comprises two goose-neck portions (17,18) separated from one another along the same stem and each made up of a flexible tube (19) and a sheath (20) of each goose-neck (17,18) has crosswise slits (20') on two diametrically opposed areas contained between two uninterrupted lateral strips (20'') parallel to the axis of the stem, in such a way as to permit the bending of the goose-neck in a direction orthogonal to the slits and not laterally toward the uninterrupted strips.

2. Guidable arm according to claim 1, wherein for each stem a first goose-neck (17) is coupled axially with a base pivot (23) and rotates around the pivot, wherein a rigid tubular element (19) is placed between the first goose-neck and the second goose-neck (18), and wherein another rigid tubular element (22) is placed between the second goose-neck (18) and the lamp head (13), with the rigid tubular elements being connected at least in the axial direction to the flexible tube (19) and to the sheath (20) of each goose-neck (17,18), at least two rigid tubular elements being interconnected by the flexible spacer (15).

3. Guidable arm according to claims 1 or 2, wherein the said spacer has two couplings (15') containing the two rigid tubular elements to be connected and two flexible bars (15'') connecting the said couplings (15').

4. Guidable arm according to claims 1 or 2, wherein the lamp head (13) is connected to the joints (16) at the free end of the stems (11) to rotate in at least one direction.

5. An arm for attaching to a base and for guiding and positioning an item, the arm comprising:

two somewhat parallel stems, each having first and second ends, said first ends being rotatably attached to the base;

an item joint, designed to hold the item, being attached to said second ends;

first and second goose-neck portions on each of said stems being separated from each other; and at least one intermediate spacer interconnecting said stems;

said goose-neck portions having a flexible tube and a sheath surrounding said flexible tube;

two uninterrupted lateral strips on each sheath of said goose-neck portion substantially axially parallel to said sheath;

cross-wise slits on two diametrically opposed areas of said sheath of each goose-neck portion, said cross-wise slits being contained between said lateral strips; and said cross-wise slits and said lateral strips configured to permit bending of said goose-neck portions orthoganol to said cross-wise slits, but not laterally toward the lateral strips.

6. An arm in accordance with claim 5, wherein:

said first end of each of said stems is axially rotatably attached to the base;

first goose-neck portions are at said first ends of each of said stems;

said intermediate spacer containing at least one flexible bar interconnecting said stems;

said flexible bar permitting reciprocal movements between said two stems in both a longitudinal and lateral direction;

the item to be guided and positioned is a lamp; and said lamp is connected to said item joint so as to rotate in at least one direction.

* * * * *